US011371115B2

(12) United States Patent
Guastini et al.

(10) Patent No.: US 11,371,115 B2
(45) Date of Patent: Jun. 28, 2022

(54) HEATING DEVICE AND CORRESPONDING APPARATUS AND METHOD

(71) Applicants: DANIELI & C. OFFICINE MECCANICHE S.P.A., Buttrio (IT); ROTELEC SA, Bagnolet (FR)

(72) Inventors: Fabio Guastini, Parigi (FR); Andrea Codutti, Moruzzo (IT); Marco Petronio, Monfalcone (IT); Nicola Gagliardi, Buttrio (IT)

(73) Assignees: DANIELI & C. OFFICINE MECCANICHE S.P.A., Buttrio (IT); ROTELEC SA, Le Perraux sur Marne (FR)

( * ) Notice: Subject to any disclaimer, the term of this patent is extended or adjusted under 35 U.S.C. 154(b) by 0 days.

(21) Appl. No.: 16/767,097

(22) PCT Filed: Nov. 22, 2018

(86) PCT No.: PCT/IT2018/050227
§ 371 (c)(1),
(2) Date: May 26, 2020

(87) PCT Pub. No.: WO2019/102511
PCT Pub. Date: May 31, 2019

(65) Prior Publication Data

US 2020/0377966 A1 Dec. 3, 2020

(30) Foreign Application Priority Data

Nov. 24, 2017 (IT) ..... 102017000135381

(51) Int. Cl.
*C21D 1/42* (2006.01)
*H05B 6/36* (2006.01)
*C21D 9/60* (2006.01)

(52) U.S. Cl.
CPC ..... *C21D 9/60* (2013.01); *C21D 1/42* (2013.01); *H05B 6/367* (2013.01)

(58) Field of Classification Search
None
See application file for complete search history.

(56) References Cited

U.S. PATENT DOCUMENTS 5,578,233 A * 11/1996 Arvedi ..... H05B 6/42 219/645
2009/0235715 A1 9/2009 Werz
2011/0036831 A1 2/2011 Warner et al.
(Continued)

FOREIGN PATENT DOCUMENTS

EP 0 429 581 A1 6/1991
EP 0 617 879 A1 10/1994
EP 2 800 452 A1 11/2014
(Continued)

OTHER PUBLICATIONS

International Search Report and Written Opinion for PCT/IT2018/050227, dated Jan. 18, 2019.

*Primary Examiner* — Scott R Kastler
(74) *Attorney, Agent, or Firm* — Marshall, Gerstein & Borun LLP

(57) ABSTRACT

A heating device and/or method to heat a slab, and in particular its edges, by electromagnetic induction, including an electric coil and a magnetic concentrator associated with the electric coil.

8 Claims, 4 Drawing Sheets

(56) References Cited

U.S. PATENT DOCUMENTS

| | | | | |
|---|---|---|---|---|
| 2018/0317285 | A1* | 11/2018 | Minen | H05B 6/365 |
| 2020/0377966 | A1* | 12/2020 | Fabio | F27D 11/06 |

FOREIGN PATENT DOCUMENTS

| | | | |
|---|---|---|---|
| JP | 2001208393 | A | 8/2001 |
| JP | 5909562 | B2 | 5/2016 |
| WO | WO-2017/002025 | A1 | 1/2017 |

* cited by examiner

HEATING DEVICE AND CORRESPONDING APPARATUS AND METHOD

FIELD OF THE INVENTION

The present invention concerns a heating device for a metal product, for example a slab, used in the field of iron and steel making, typically but not exclusively in casting plants, advantageously continuous casting for slabs and advantageously for thin slabs. Here and hereafter by the term slab we mean slabs, strip, plate, or other flat metal products, having edges and/or corners.

More particularly, the present invention can be used in the case when it is necessary to heat slabs to the desired temperature. The heating device is configured to heat slabs by means of electromagnetic induction.

The present invention also concerns a heating apparatus suitable to heat the slabs for bringing the temperature of their edges and/or corners to a desired value.

The present invention also concerns a heating method able to optimize the energy used.

BACKGROUND OF THE INVENTION

In the production of slabs it is known that they have to be heated to keep them at a predetermined temperature, in order to obtain a product that has the desired characteristics and is free of cracks and/or other defects.

This can be obtained by means of suitable induction heating apparatuses which, by means of electric currents induced in the slab, allow it to be heated by means of the Joule effect.

There are heating apparatuses for slabs which have two inductors located on two parallel lying planes between which there is a transit space for the slab, in which the magnetic field generated by the inductors is perpendicular to the slab.

These heating apparatuses are also referred to as transverse flow heating apparatuses.

It is known that the edges and/or corners of the slabs dissipate heat more easily than other zones of the slab, and are therefore cooler than the central zone of the slab.

When the slab passes through the rolling stands, the edges of the slab can cool further.

It can therefore happen that at least part of the slab, particularly the edges, has a lower temperature, for example, than the austenitic transformation temperature.

In such conditions there is a high likelihood that cracks or other unwanted imperfections will occur in the slab.

Heating apparatuses are known which allow to obtain partial results, but not always satisfactory, particularly in terms of energy, consistency and quality of results.

Document JP-B-5.909.562, corresponding in modified form to document EP-B-2.800.452 (EP'452), describes a transverse flow induction heating apparatus.

However, the apparatus described in EP'452 has high energy consumption and does not allow to optimize the transfer efficiency of heating power to the slab, with consequent dispersions outside the slab.

This is because the energy contribution of the short sides of the coils, that is, the lateral portions substantially parallel to the direction of feed of the slab, is dispersed and not used.

Under these conditions, in order to compensate for the losses of the magnetic flow on the short sides of the coils, and thus to obtain the desired heating on the edges, it is typically necessary to increase the electric current supplied to the coils. This, however, leads to an increase in energy consumption, and the need to increase the action of cooling the coils, in order to prevent them overheating.

Alternatively, in the event that it is not possible to increase the electric current, it is necessary to reduce the feed speeds of the slab, in order to obtain the required heating, with a consequent reduction in productivity.

Furthermore, known solutions can have problems with maintenance and/or replacement of inductors, with high storage and material costs, plant shutdown costs, and reduced production, as well as of disposal.

The heating apparatus described in EP'452 has a plurality of magnetic concentrators associated with the coils which, in addition to requiring complex assembly operations, nevertheless do not allow to efficiently transfer the power generated.

From WO 2017/002025 (WO'025) a transverse flux heating apparatus for metal products is known, wherein the poles of the inductors can be moved in order to compensate both the so-called "power gap" and the overheating of the edged that is created naturally in the inductive heating with transverse flux. In addition to the movement of the poles, in WO'025 it is not provided a coverage and closure of the coils of the inductors by means of the concentrators. The concentrators disclosed in WO'025 can assume a L-shape, a C-shape or have only a coverage function.

The central element between the coils is made by a segment that acts only on the "power gap".

Therefore, WO'025 discloses conductors used for local heating with high frequency of metallic components to be subjected to mechanical deformation and thermal treatment. This document, in addition, discloses solutions that employ the magnetic concentrators for increasing the heating efficiency. This heating efficiency increases in particular at high frequencies, for example between 200 kHz and 1 Mhz, but has not effect on the overheating of the edges at low frequencies.

US 2011/0036831 discloses a heating device for thin strips made in high electric conductivity material, by means of an inductor with transverse flux made by a plurality of adjacent spirals, supplied by a single source and provided with ferromagnetic elements able to concentrate the flux on the strip. However, in this case too, the spirals are not closed by a concentrator in correspondence with the edge of the strip. The concentrators embrace the conductors in a partial manner, not filling the spirals and not being able to transmit in a reliable manner the power.

There is therefore a need to perfect the state of the art and to make available a heating apparatus and device, as well as the corresponding method, which overcome at least one of the disadvantages of the state of the art.

The purpose of the present invention is to provide a heating device able to efficiently heat the edges of the slab.

It is also a purpose to maximize the power transferred to the edges of the slab.

It is a purpose of the present invention to minimize energy consumption and, in particular, the electric current needed to bring the temperature of the edges of the slab to a desired temperature while still providing a certain heating at the center of the slab.

It is a purpose of the invention to heat the edges of a slab to the desired temperature value by maximizing the feed speed of the slab and therefore the production of the plant.

It is a purpose of the present invention to reduce maintenance problems in addition to storage and disposal costs.

It is another purpose of the present invention to reduce the costs of plant shutdown.

It is also a purpose of the present invention to supply an induction heating apparatus which no longer requires complex assembly and maintenance operations.

It is another purpose to supply a heating device that is able to concentrate the energy generated by it inside the slab, and particularly in the edges.

It is also a purpose of the present invention to supply a method that concentrates at least most of the energy generated by the coil, by reinforcing the heating with particular reference to the longitudinal edges of the slab.

It is also a purpose to supply a heating device and a corresponding apparatus able to use the power generated by the lateral portions of the coils to heat the edges of the slabs in a desired manner.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purposes, the present invention concerns an induction heating device to heat metal products, particularly slabs, that comprises an electric coil and a magnetic concentrator associated with the electric coil. The electric coil comprises longitudinal tracts, each of which extends in a longitudinal direction, orthogonal to the winding axis, beyond the width of the slab to be heated, and connection tracts connecting said longitudinal tracts and substantially orthogonal to them, wherein the connection tracts are external, in use, to the edges of the slab to be heated.

The magnetic concentrator is configured to concentrate the power generated by the electric coil toward the slab, and in particular, but not only, towards and in correspondence of the longitudinal edges of the latter.

In accordance with one aspect of the present invention, the magnetic concentrator comprises, for each side of the slab to be heated, at least one wall located outside of a relative connection tract of the coil and facing toward it.

The wall of the magnetic concentrator, disposed at the outside and in substantial closure and coverage of the relative tract of the electric winding, allows not to disperse the magnetic field generated by the connection tract of the electric coil and to concentrate the resulting magnetic induction toward the central part of the magnetic concentrator in order to maximize the power transferred to the slab and in particular, but not only, to its edges.

In accordance with a variant of the invention, the magnetic concentrator comprises at least two segments connected to the wall, located outside the longitudinal tracts of the coil and facing toward the latter.

The segments of the magnetic concentrator allow not to disperse the magnetic field generated by the part of the longitudinal tracts, so as to reinforce the power transferable to the slab.

In accordance with another variant, the magnetic concentrator comprises at least a covering wall located outside the electric coil, facing toward the latter and connected at least to a wall and to the corresponding segments in order to cover at least part of the electric coil in proximity to the wall.

The walls and/or the segments extend in a parallel or inclined direction, to the winding axis in order to cover the connection tracts and at least part of the longitudinal tracts.

According to a possible variant, the walls and/or the segments extend in a direction inclined to the winding axis in order to cover the connection tracts and at least part of the longitudinal tracts of the coil.

The above-disclosed configuration of the magnetic concentrator allows to concentrate the magnetic induction generated by the electric coil, directing the power generated by the electric coil toward the slab, without the power being dispersed in directions not intended for the heating of the slab.

In particular, this configuration allows to overheat the edges of the slabs, also having different lengths, without physically moving portions of the inductors, allowing in addition to operate on different widths of the product, thanks to the fact that the coil or electric winding is always sized in such a way to laterally protrude, together with the concentrator, with respect to the width of the metal product.

According to possible embodiments, the magnetic concentrator comprises a central body protruding along the winding axis, located in the electric coil and that extends in the longitudinal direction, that is, between the longitudinal tracts of the electric coil.

In accordance with possible solutions, the magnetic concentrator comprises a plate, the flat development of which is located orthogonal to the winding axis and facing toward the electric coil.

According to possible embodiments, the segments extend along the entire length of the longitudinal tracts.

In accordance with possible solutions, the electric coil is provided with at least two power terminals exiting from at least one of the lateral portions and configured to electrically connect the electric coil to an electric power source.

The present invention also concerns an induction heating apparatus for a slab that comprises at least two heating devices as in any of the embodiments described above, located on two parallel lying planes and with the respective electric coils facing each other to define a transit space for the slab.

In accordance with possible solutions, advantageously, the heating apparatus can provide that the only parts left uncovered of the two electric coils are those facing each other and between which, during use, the slab transits.

According to possible solutions, the present invention also concerns a method to heat a slab using a heating apparatus as any of the embodiments described, which provides to concentrate the magnetic induction generated by the connection tracts of each electric coil by the respective walls and/or segments associated therewith and toward the corresponding central body and/or plate in order to reinforce the power transferred from the electric coils to the slab.

BRIEF DESCRIPTION OF THE DRAWINGS

These and other characteristics of the present invention will become apparent from the following description of some embodiments, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

Embodiments described here, with reference to the drawings, concern a heating device 20 for heating a slab 21 by electromagnetic induction.

In order to simplify the description, we will refer to a slab 21, this term comprising slabs, strip, plate or other flat metal products, in which there are edges 22 and/or corners 23.

Figure 6:
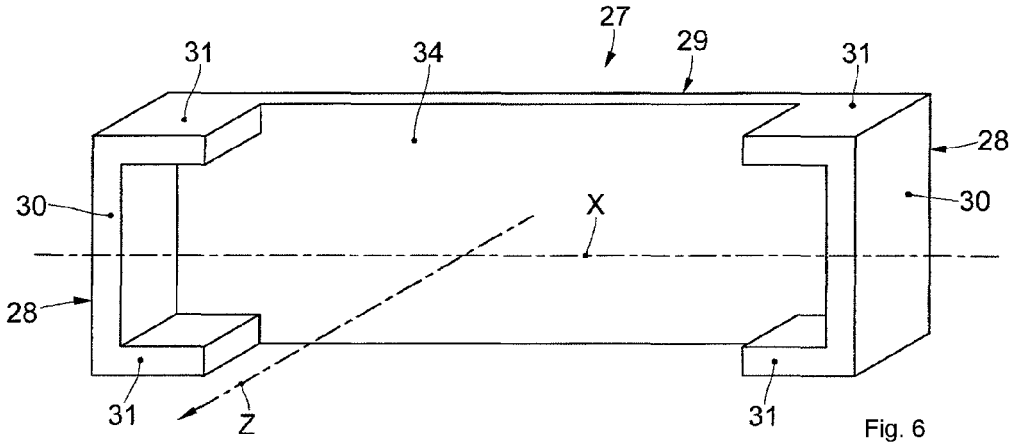
Figure 7:
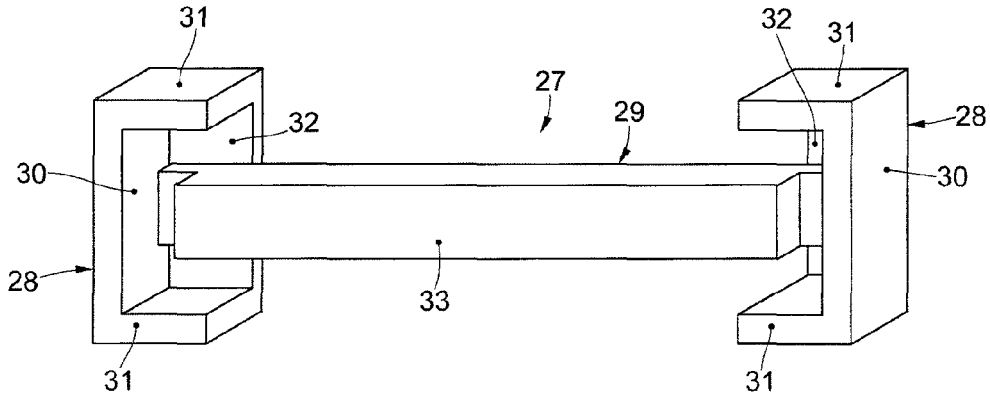

According to the invention, the heating device 20 comprises an electric coil 24 defined around a winding axis Z and having at least two longitudinal tracts 25 extending in a longitudinal direction X, orthogonal to the winding axis Z (see FIG. 6), and at least two transversal connection tracts 26 connecting longitudinal tracts 25. The connection tracts 26 of the electric coil 24 are disposed, in use, externally to the respective edges 22 of the slab 21 to be heated.

Here and hereafter in the description, it is intended that the slab 21 is made to advance in a direction of feed Y substantially perpendicular to the longitudinal direction X.

According to possible embodiments, the electric coil 24 can consist of an electric cable having a square, circular or polygonal section, which is wound around the winding axis Z to obtain a plurality of spirals.

Each electric cable can have a transverse bulk comprised between 10 mm and 50 mm.

In the case of an electric cable with a square cross section, the side of the square that defines the cross section can be comprised between 10 mm and 50 mm.

Advantageously, the side of the square can be equal to about 30 mm, while in the case of an electric cable with a circular cross section its diameter can be equal to about 30 mm.

According to advantageous solutions of the present invention, the sizes of the transverse bulk of the electric coil 24 can be comprised between 25 mm and 300 mm, advantageously equal to about 115 mm.

Advantageously, in the case of an electric coil 24 having a transverse bulk with a quadrilateral shape, the ratio between the transverse sides that define the quadrilateral can be comprised between 0.15 and 6.7.

According to advantageous solutions, considering a defined width of the slab 21, the longitudinal tracts 25 can have a longitudinal extension comprised between 1.1 times and 6 times the width of the slab 21.

Even more advantageously, the longitudinal tracts 25 can have a longitudinal extension comprised between 2 and 5 times the width of the slab 21.

For example, the slab 21 has a width comprised between 600 mm and 4000 mm.

According to possible embodiments, the electric coil 24 can be made of a conductive material, for example a material having a high electro-conductivity, such as copper.

According to possible embodiments, the electric cable that constitutes the electric coil 24 can be cooled by a cooling liquid made to transit in contact with it.

In order to slow down the deterioration of the electric cable, the latter can be located inside respective cooling ducts where a cooling liquid passes, such as for example water, oil, or other temperature conducting fluid.

The heating device 20 also comprises a magnetic concentrator 27 associated with the electric coil 24 and provided with at least two lateral portions 28 connected to each other by means of a connection portion 29.

By the term "connected", we mean that the lateral portions 28 are connected to each other in continuity with the connection portion 29, and also that the lateral portions 28 are connected to each other in continuity with the connection portion 29, that is, the magnetic flow lines can circulate between them even in the presence of a minimum gap.

The magnetic concentrator 27 and its components can comprise a plurality of magnetic metal foils, overlapping and clamped to each other to form a single body, or an assembly consisting of a plurality of magnetic sectors, in a known manner.

The magnetic foils can be made of ferromagnetic material such as for example iron, nickel, cobalt, their alloys or other suitable materials.

The magnetic concentrator 27 can be made completely, or partly, of one or more magneto-dielectric compact materials, which are not in laminated form.

For example, a magneto-dielectric compact material can comprise ferromagnetic metal powders incorporated in an insulating matrix.

The lateral portions 28 can be connected to the connection portion 29 in a removable manner. This simplifies assembly and/or maintenance operations.

In accordance with one aspect of the present invention, each of the lateral portions 28 comprises a wall 30.

Figure 8:
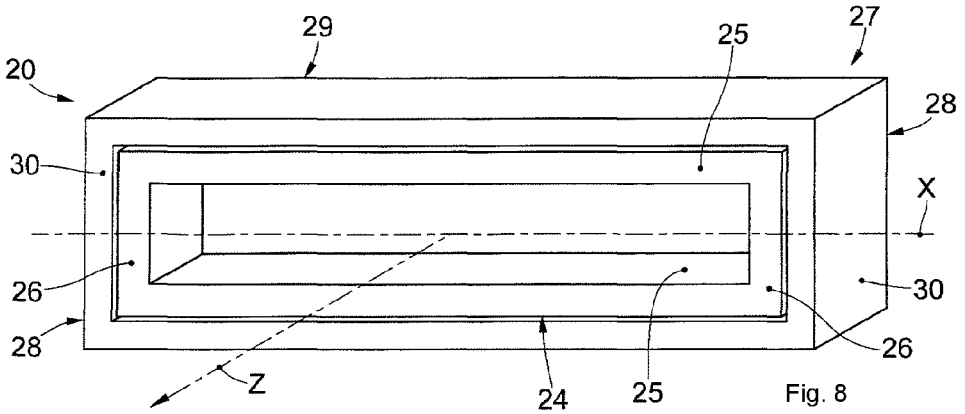
Figure 9:
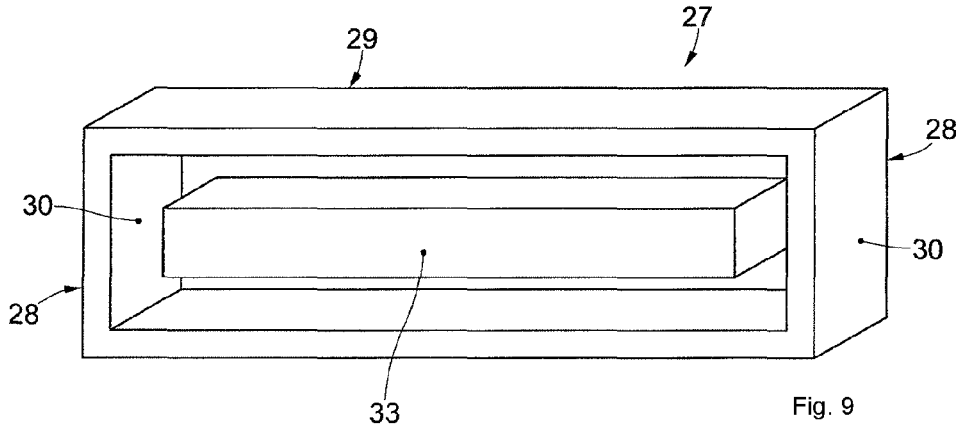
Figure 10:
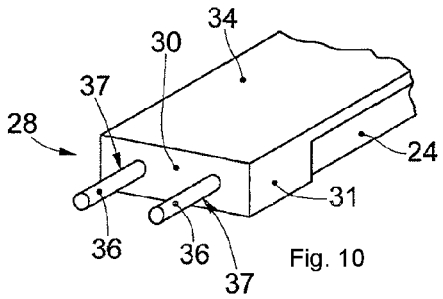
FIGS. 10-12 show three possible embodiments of a detail of a heating device according to the present invention.
Figure 11:
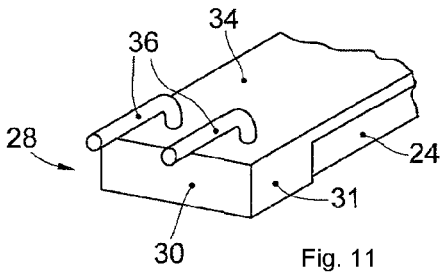
Figure 12:
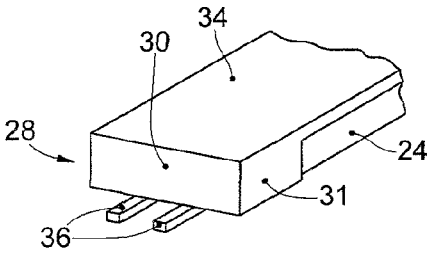

Each wall 30 of the magnetic concentrator 27 is located outside of a respective connection tract 26 of the electric coil 24 and facing toward the latter, as can be seen in FIG. 8, substantially enclosing from the outside the connection tract 26.

According to possible embodiments, the wall 30 is located orthogonal to the longitudinal direction X.

According to possible embodiments, the wall 30 has a shape mating with the peripheral profile of the connection tract 26.

According to possible embodiments, each of the lateral portions 28 of the concentrator 27 can comprise at least one segment 31 located outside a respective longitudinal tract and facing toward the latter.

According to possible embodiments, the segment or segments 31 are connected to the wall 30.

The segments 31 are located outside the respective longitudinal tracts 25 and facing toward the latter.

According to possible embodiments, the magnetic concentrator 27 comprises two segments 31 located at the side of the wall 30. For example, four segments 31 can be provided, located two by two at the side of a respective wall 30.

The lateral portions 28, or the walls 30 and/or the segment and/or segments 31, extend parallel to the winding axis Z to cover and close from the outside the connection tracts 26 and at least part of the longitudinal tracts 25 of the coil 24.

According to possible solutions, the lateral portions 28 extend in an inclined direction to the winding axis Z to cover and close from the outside the connection tracts 26 and at least part of the longitudinal tracts 25.

According to possible embodiments, the wall 30 covers the extension, that is, the thickness, of the connection tracts 26 and of the longitudinal tracts 25 in directions parallel to the winding axis Z.

The lateral portions 28 of the concentrator 27 allow to use the power generated by the connection tracts 26 of the electric coil 24, which is added to the contribution generated by the longitudinal tracts 25, thus making the overall transfer of power to the slab 21 more efficient, and in particular to its edges 22 and in proximity to them.

Thanks to the reinforcement of the magnetic induction due to the conformation of the lateral portions 28 connected to each other by means of the connection portion 29, it is possible to heat the edges 22 of the slab 21 efficiently, since the power transferred to the latter is increased by the contribution of the connection tracts 26.

In contrast to the prior art, thanks to the provision of the external walls 30 of the concentrator 27, the power generated by the connection tracts 26 is not dispersed in directions not intended for heating the slab 21, but is concentrated towards the connection portion 29 which transfers it to the slab 21.

In accordance with possible solutions, the lateral portions 28 can comprise a covering wall 32 located outside the electric coil 24 and facing toward the latter.

The covering wall 32 can be connected at least to the wall 30 and possibly to the segments 31.

The covering wall 32 is configured to cover at least part of the electric coil 24 on a plane perpendicular to the winding axis Z and in proximity to the wall 30.

The presence of the covering walls 32 associated with the connection tracts 26 and with part of the longitudinal tracts 25 allows to transfer the power generated by the portions covered by the covering wall 32 to the slab 21.

Consequently, in this case, part of the electric coil 24 is left uncovered by the lateral portions 28, said part left uncovered facing the slab 21 during use.

According to possible embodiments, the connection portion 29 comprises a central body 33 protruding along the winding axis Z.

The central body 33 is located in the electric coil 24 and extends along the longitudinal direction X.

Between the central body 33 and the walls 30 of the lateral portions 28 two passage spaces can be provided for the electric coil 24, in particular for the connection tracts 29.

The central body 33 allows to transfer, during use, the power generated by the longitudinal tracts 25 to the slab 21 while it is passing in the direction of feed Y.

According to possible embodiments, the connection portion 29 comprises a plate 34 with a plane development located orthogonal to the winding axis Z and facing toward the electric coil 24.

According to possible solutions, the segments 31 extend along the entire length of the longitudinal tracts 25.

The presence of the plate 34 and/or the segments 31 extending along the entire length of the longitudinal tracts 25 allows to concentrate the power generated by the latter and not to disperse energy in directions not intended for heating the slab 21.

Advantageously, the presence of the walls 30 extending along the entire length of the connection tracts 26, that is, which entirely cover the latter, allows to concentrate the power generated by them and not to disperse energy in directions not intended for heating the slab 21.

It should be noted that the magnetic concentrator 27 can advantageously be made in a single body. In particular, the wall 30 and/or the segments 31 and/or the covering wall 32 and/or the central body 33 and/or the plate 34 can be made in a single body.

According to possible embodiments, the wall 30 and/or the segments 31 are connected to the central body 33 and/or to the plate 34 in a removable manner.

In accordance with possible embodiments, the electric coil 24 is provided with at least two supply terminals 35 exiting from at least one of the lateral portions 28 and configured to electrically connect the electric coil 24 to an electric power source 36.

The electric power source 36 can be associated with adjustment devices to vary the intensity of the electric current, the electric voltage, and the supply frequency.

Figure 4:
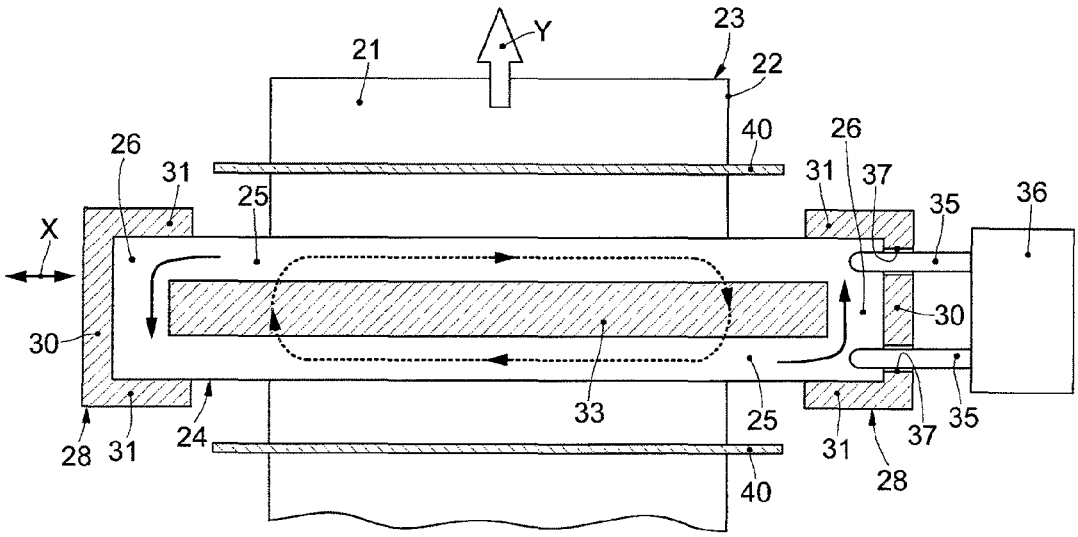
FIG. 4 is a section view along the line IV-IV.
Figure 5:
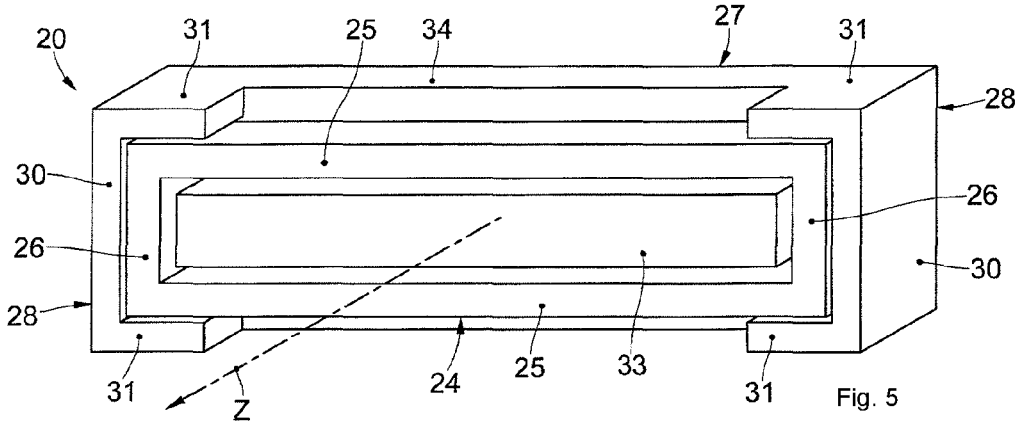
FIGS. 5-9 are perspective views of possible heating devices according to five embodiments of the present invention.

FIG. 4 illustrates the path of the electric current in the electric coil 24 with a continuous arrow and the path of the electric current induced in the slab 21 with a dotted line.

According to possible embodiments, at least one of the lateral portions 28 comprises at least one aperture 37, in which at least one of the supply terminals 35 is located.

Figure 1:
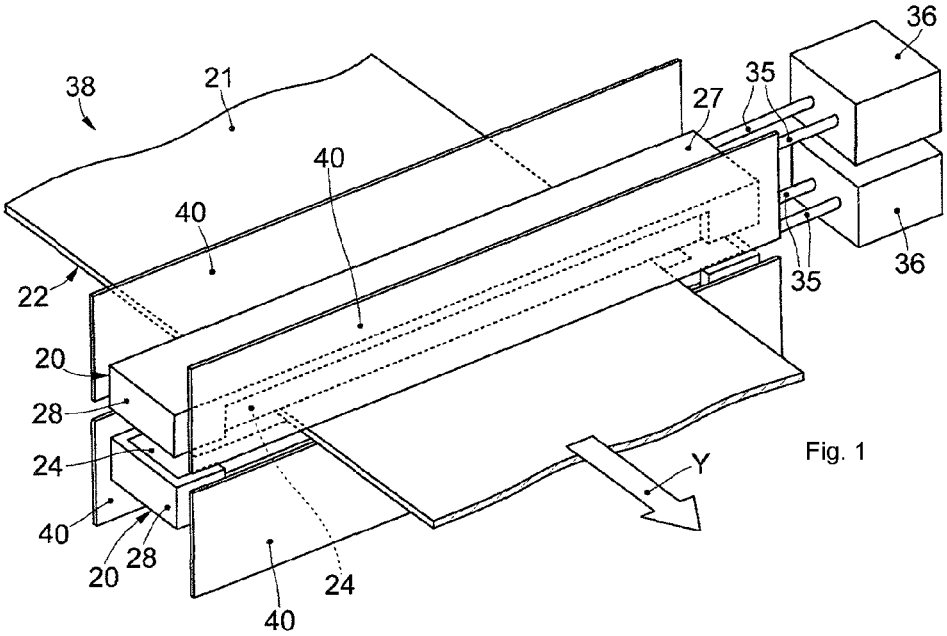
FIG. 1 is a perspective view of a heating apparatus according to one of the embodiments of the present invention.
Figure 2:
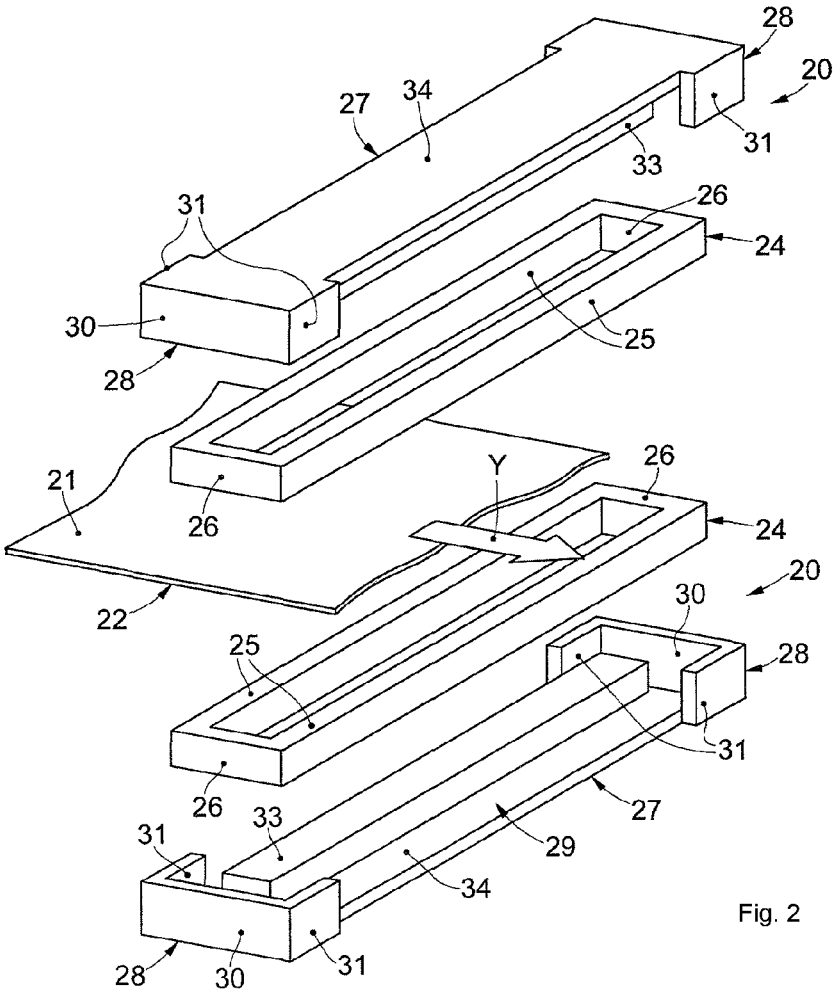
FIG. 2 is an exploded view of a heating apparatus according to one of the embodiments of the present invention.

In accordance with possible solutions, shown in FIG. 1, the present invention also concerns a heating apparatus 38 for a slab 21 by electromagnetic induction.

The heating apparatus 38 comprises at least two heating devices 20 as in any one of the embodiments described above, located on two substantially parallel lying planes and with the respective electric coils 24 facing each other and between which there is an intermediate space 39 for the transit of the slab 21.

According to possible embodiments, not shown, the space 39 can be varied by modifying the reciprocal position of the two heating devices 20.

In accordance with possible solutions, the electric coils 24 are connected to respective electric power sources 36 configured to autonomously condition the polarity of each of the components of the magnetic concentrator 27.

According to possible embodiments, the electric coils 24 of each heating device 20 are connected to respective electric power sources 36 to command the autonomous functioning of each heating device 20.

This conditioning is actuated by modifying the direction of travel of the electric current through the electric coil 24.

Figure 3:
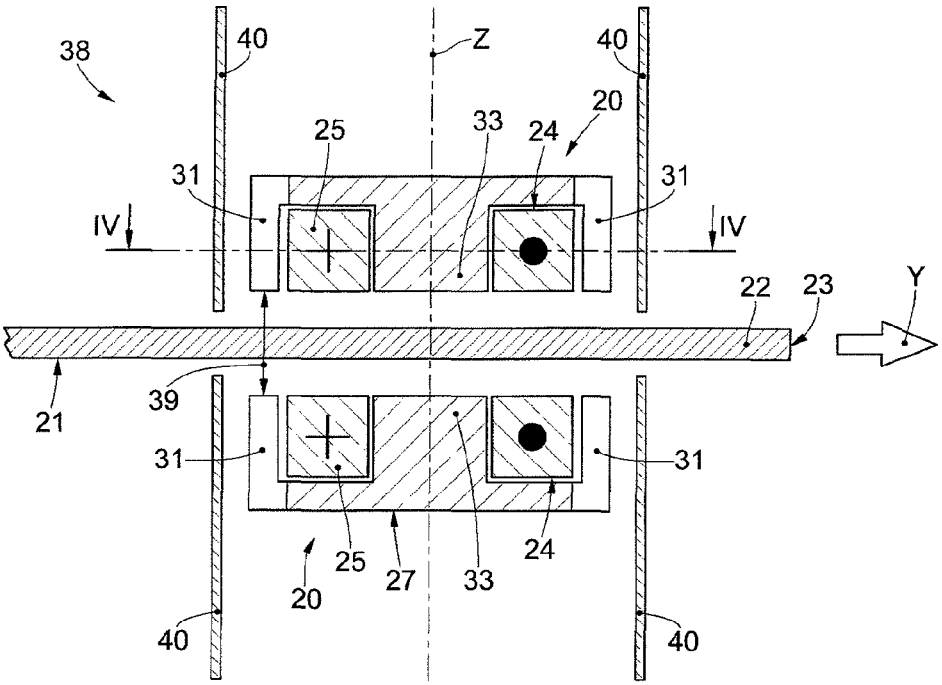
FIG. 3 is a section view of FIG. 1.

In FIG. 3, the electric coils 24 are characterized by the direction of the electric current: "+" indicates an incoming electric current and "•" indicates an outgoing electric current.

According to possible solutions, the heating apparatus 24 can comprise electromagnetic screens 40 configured to screen other bodies and/or elements located near the heating element 24 from the magnetic field generated by the magnetic concentrators 27.

The electromagnetic screens 40 can be located at the side of the magnetic concentrators 27 and parallel to the longitudinal tracts 25.

The heating apparatus 38 exploits the presence of the lateral portions 28 to heat mainly the edges 22 of the slab 21, also transmitting part of the power in the central zone of the slab 21 itself.

According to possible embodiments, the heating apparatus 38 can be installed before a rolling train, for example before the roughing or finishing stand.

This allows to improve the heat profile of the slab 21 and also to bring the temperature of the edges 22 to a desired value, so as to compensate for the further heat dissipation of the edges 22 during the passage of the slab 21 in the heating apparatus 38.

According to further solutions, the present invention also concerns a method for heating slabs 21 which provides to concentrate the magnetic induction generated by the connection portions 26 of each electric coil 24 by means of the respective lateral portions 28, that is, the respective walls 30 and/or segments 31 associated therewith, and toward the corresponding connection portion 29, that is, the central body 33 and/or the plate 34, so as to reinforce the power transferred from the coils to the slab 21, particularly to the edges 22 of the latter.

It is clear that modifications and/or additions of parts can be made to the heating device 20, the heating apparatus 38 and the heating method as described heretofore, without departing from the field and scope of the present invention.

It is also clear that, although the present invention has been described with reference to some specific examples, a person of skill in the art shall certainly be able to achieve many other equivalent forms of heating device 20, the heating apparatus 38 and the heating method, having the characteristics as set forth in the claims and hence all coming within the field of protection defined thereby.

The invention claimed is:

1. A heating device to heat a slab, having edges, by electromagnetic induction comprising:

an electric coil defined around a winding axis and having at least two longitudinal tracts extending in a longitudinal direction, beyond the width of the slab to be heated, orthogonal to said winding axis and perpendicular to a direction of feed along which the slab is made to advance, and at least two connection tracts connecting and substantially orthogonal to said longitudinal tracts, said connection tracts being in use external to the edges of said slab to be heated, a magnetic concentrator positioned adjacent said electric coil and configured to transfer the power generated by said electric coil to said slab, said magnetic concentrator comprising two lateral portions connected to each other by a connection portion, said connection portion comprising a plate with a plane development located orthogonal to the winding axis and facing toward the electric coil and extending along the entire length of the longitudinal tracts, wherein said magnetic concentrator comprises at least a wall located outside a respective connection tract of said electric coil and facing toward the electric coil for substantially enclosing the electric coil, and further wherein the magnetic concentrator comprises a central body protruding along said winding axis, the central body located in said electric coil and extending in said longitudinal direction.

2. The heating device as in claim 1, wherein said magnetic concentrator further comprises at least one segment located outside a respective one of the longitudinal tracts and facing toward the said respective longitudinal tract.

3. The heating device as in claim 2, wherein said magnetic concentrator comprises two segments located at the side of said wall.

4. The heating device as in claim 2, wherein said wall and/or said segment extend parallel to said winding axis, to cover said connection tracts and at least part of said longitudinal tracts.

5. The heating device as in claim 2, wherein said magnetic concentrator comprises a covering wall located outside said electric coil, facing toward the electric coil and connected at least to said wall.

6. An electromagnetic induction heating apparatus for a slab, comprising at least two heating devices as in claim 1, located on respective lying planes substantially parallel and with respective electric coils facing each other to define an intermediate space for the transit of said slab.

7. An apparatus as in claim 6, wherein said electric coils of each heating device are connected to respective electric power sources, and wherein the apparatus further comprises a control unit connected to said electric power sources to command the autonomous functioning of each heating device.

8. A method to heat a slab by means of a heating apparatus as in claim 6, which provides to concentrate the magnetic induction generated by said connection tracts of each electric coil by means of the respective walls and/or segments of a magnetic concentrator associated therewith and toward the corresponding central body and/or plate in order to reinforce the power transferred from said electric coils to said slab.

* * * * *